US005365027A

United States Patent [19]

Marvet et al.

[11] Patent Number: 5,365,027

[45] Date of Patent: Nov. 15, 1994

[54] SLIDE SWITCH ASSEMBLY

[75] Inventors: Lawrence E. Marvet, Sunrise; Scott T. Ma, Margate; Son Q. Le, Sunrise; Douglas D. Peebles, Ft. Lauderdale; David Karl, Tamarac; William C. Phelps, III, Plantation, all of Fla.

[73] Assignee: Motorola, Inc., Schaumburg, Ill.

[21] Appl. No.: 971,137

[22] Filed: Nov. 3, 1992

[51] Int. Cl.[5] ..... H01H 15/02

[52] U.S. Cl. ..... 200/16 D

[58] Field of Search ..... 200/16R-16 F, 200/16 C, 16 D; 455/89, 90, 99

[56] References Cited

U.S. PATENT DOCUMENTS

| | | | |
|---|---|---|---|
| Re. 17,897 | 12/1930 | Bramming | 200/16 D |
| 3,329,778 | 7/1967 | Bedocs | 200/16 C |
| 3,525,828 | 8/1970 | Eckhart et al. | 200/16 |
| 3,592,983 | 7/1971 | Kroll et al. | 200/16 R |
| 3,745,270 | 7/1973 | Granitz | 200/16 C |
| 3,946,390 | 3/1976 | Alexander et al. | 343/702 |
| 4,038,505 | 7/1977 | Gasparaitis et al. | 200/51.1 |
| 4,114,000 | 9/1978 | Feder | 200/16 R |
| 4,257,121 | 3/1981 | Henderson et al. | 455/89 |
| 4,286,335 | 8/1981 | Eichler et al. | 455/89 |
| 4,370,529 | 1/1983 | Loose | 200/16 D |
| 4,845,325 | 7/1989 | Burchett et al. | 200/302.2 |
| 5,174,775 | 12/1992 | Birch | 439/188 |

*Primary Examiner*—J. R. Scott

*Attorney, Agent, or Firm*—Pedro P. Hernandez

[57] ABSTRACT

Switch assembly (100) includes a housing (112) having a pair of spring finger contacts (114and 116) and a circuit board (144). A spring loaded actuator (134) is slideably located within housing (112) between first and second switching positions. Actuator (134) includes a pair of conductive wipers (136 and 138) which move relative to metalized traces (146, 148 and 150) located on the top surface of circuit board (144). Switch assembly (100) provides for a compact surface mountable switch which is capable of switching RF signals between a radio antenna (618) and an external accessory connector while minimizing electrical signal path lengths and moving parts in the switch assembly.

7 Claims, 4 Drawing Sheets

SLIDE SWITCH ASSEMBLY

TECHNICAL FIELD

This invention relates generally to the field of switch assemblies, and more specifically to a switch assembly for use with communication devices.

BACKGROUND

In communication devices such as radios, it is common to provide an external connector on the radio for use in connecting external accessories to the radio. Some of the external accessories such as speaker/microphones with remote antennas, vehicular adapters, etc. require that once the external accessory is connected to the radio connector, the radio automatically reroute the radio frequency (RF) signals from the radio's primary antenna to the external accessory via the external connector. The routing of the RF signals is usually accomplished using some form of switching device which cooperates with the radio's external connector. A typical RF switching device is described in U.S. Pat. No. 3,946,390, by Alexander et al.

Among the problems encountered with prior art switching devices include their large size, the amount of movable parts required to perform the switching function and the long electrical path lengths from the radio's printed circuit board to the external radio connector causing reduction of the RF signal strength through the switch. A need thus exists for a switch assembly which can solve the above mentioned problems.

DETAILED DESCRIPTION OF THE PREFERRED EMBODIMENT

Figure 1:
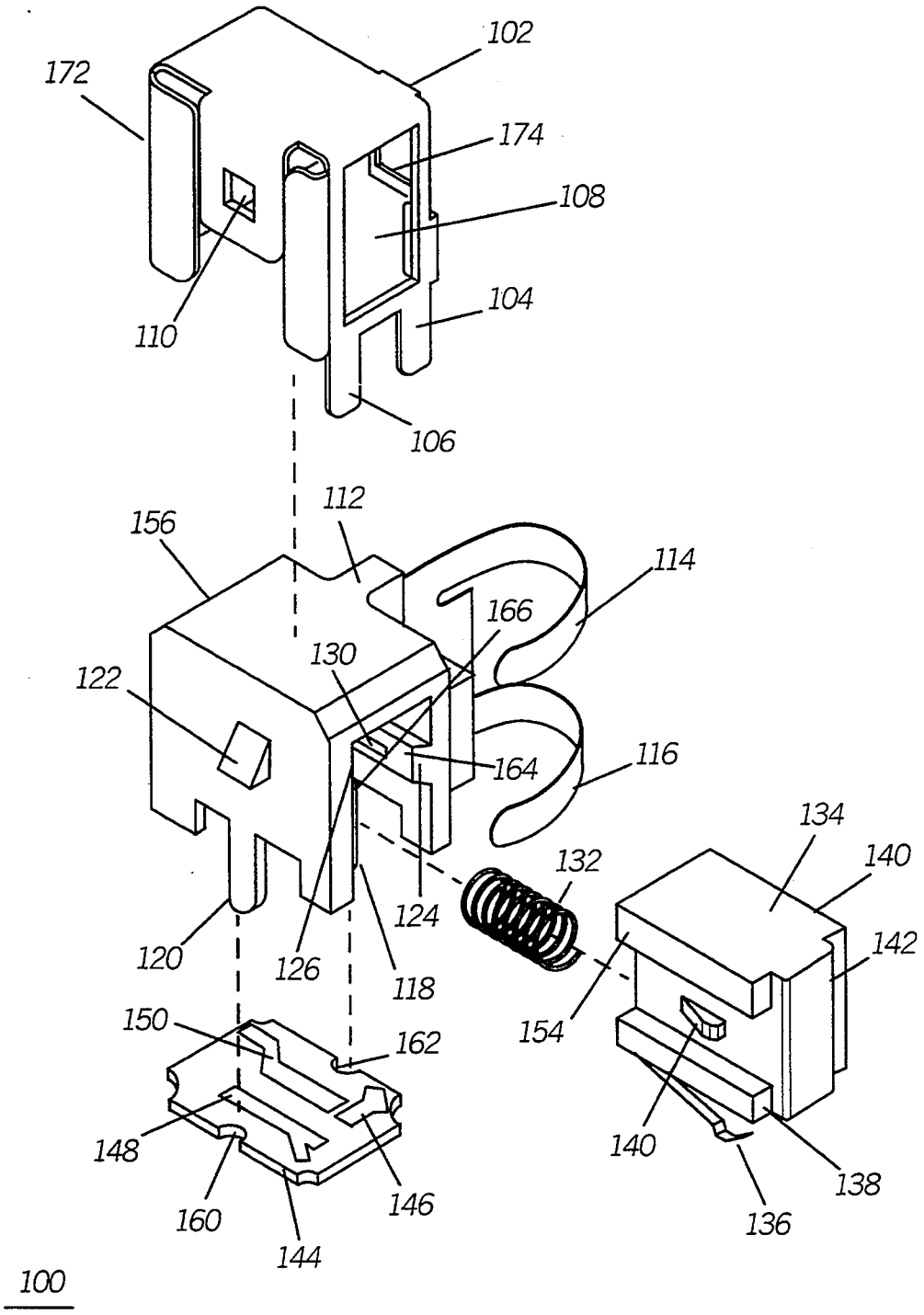
FIG. 1 is an exploded view of a switch assembly in accordance with the present invention.

Referring now to the drawings and more specifically to FIG. 1, there is shown an exploded view of a switch assembly 100 in accordance with the present invention. Switch assembly 100 includes a switch printed circuit board (PCB) 144 which includes a first metalized (conductive) trace 148, a second metalized trace 146 and a third metalized trace 150 located on the top surface of PCB 144. PCB 144 also includes a pair of side notches 160 and 162.

Mounted on the top of PCB 144 is a switch housing 112 which includes a pair of spring finger contacts 114 and 116, both of which are preferably insert molded to housing 112. Spring finger contacts 114 and 116 can be formed from a number of well known spring metal compounds such as beryllium copper, nickel silver, etc. Spring finger contacts 114 and 116 in the preferred embodiment are substantially "U-shaped" and at a substantially right angle to PCB 144. Housing 112 further includes a pair of alignment members 118 and 120 located on opposite sides of housing 112. Alignment members 118 and 120 are press fitted to corresponding side notches 160 and 162 located on PCB 144.

A guide means such as a pair of opposing side rails 124 and 126 are located on the inside side walls of housing 112 and are used to guide actuator 134. Each side rail 124 and 126 includes a cut-out channel (only channel 130 is shown in FIG. 1 ) along a substantial portion of the length of each of the guide rails 124 and 126. The channels are used to guide side notches 140 located on actuator member 134. FIG. 1 shows one of the notches 140 located on actuator member 134. At one end of each of the cut-out channels 130 there is found a notch stop 164 and 166. Notch stops 164 and 166 stop actuator member 134 from being forced out of open end 168 once actuator member 134 is inserted. Side notches 140 include a sloped face which allows the notches to be pressed over notch stops 164 when actuator member 134 is first inserted into housing 112.

Actuator member 134 includes a cylindrical cavity 502 (shown in FIG. 5) for receiving return spring 132. At the bottom surface of actuator 134 are a pair of conductive wipers 136 and 138 which are insert molded to member 134. A pair of guide ledges 154 are located on each of the sides of actuator 134 and are used to guide actuator 134 along guide rails 124 and 126 in housing 112.

Finally, a clip-on bracket 102 slips on to the top of housing 112 and is latched to housing 112 by notches 122 and 170 which grab on to corresponding apertures 110 and 174 found on bracket 102. Clip-on bracket 102 is preferably formed from a single piece of metal and provides electrical magnetic interference (EMI) protection to switch 100, given that bracket 102 is preferably placed at ground potential by connecting bracket to a ground potential contact on PCB. A pair of bendable fingers 104 and 106 provide added support to the assembly and are preferably bent around the edge of the printed circuit board (circuit board 202 shown on FIG. 2) which will carry switch assembly 100. Bracket 102 includes a back wall 172 which is used by return spring 132 to push (spring load) actuator 134 away upon assembly of switch 100 in the direction of aperture 108. As mentioned previously, notch stops 164 and 166 prevent actuator 134 from traveling any further away from wall 172 than required. Clip-on bracket 102 has a front opening 108 which allows for actuator 134 to be depressed by pushing up against actuator wall 142.

Switch assembly 100 preferably does not require the use of any mechanical fasteners such as screws, etc. All the parts are preferably press fitted or captivated, thereby providing ease of assembly. Although shown as a separate piece, PCB 144 could have been integrated into housing 112 by any of a number of known techniques such as insert molding, etc.

Figure 2:
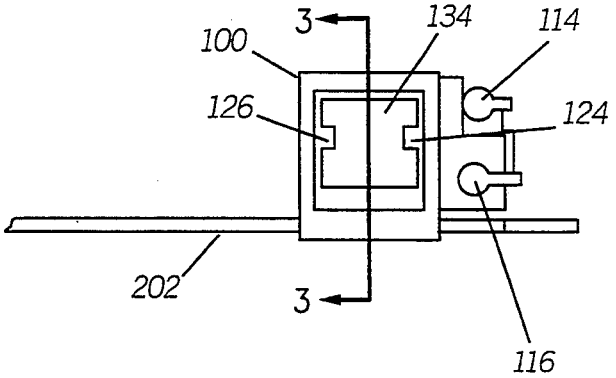
FIG. 2 is a side view of the switch assembly.

In FIG. 2, a front view of switch assembly 100 is shown surface mounted onto a printed circuit board 202. Actuator member 134 is shown riding on guide rails 124 and 126. On the side of assembly 100 are spring finger contacts 114 and 116. In the preferred embodiment. spring finger contact 114 receives a ground potential from circuit board 202 and provides it to an external electrical connector. Spring finger contact 116 acts as the RF center conductor and carries RF from PCB 202 to the external radio connector whenever switch 100 is activated (actuator 134 is pressed inward at wall 142).

Figure 3:
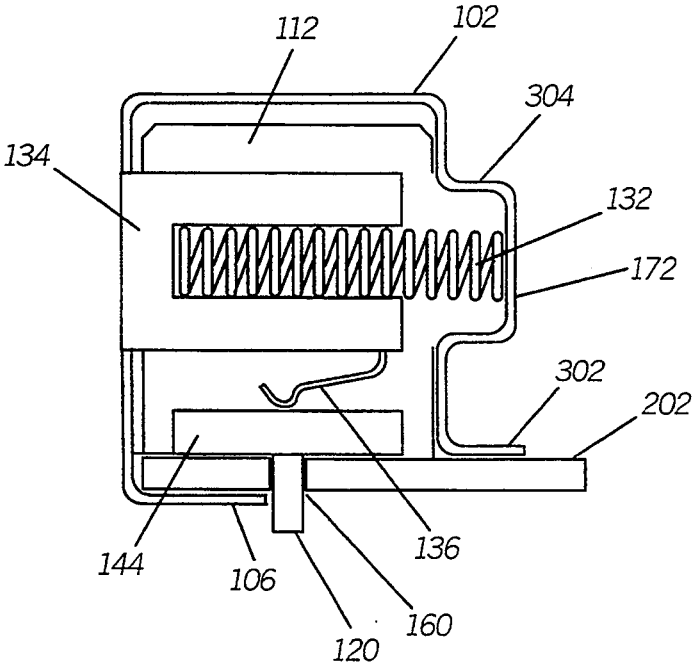
FIG. 3 is a cross-sectional view of the switch assembly in FIG. 2 taken at line 3—3.

In FIG. 3, a cross-sectional view of FIG. 2 taken along line 3—3 is shown. Housing 112 is shown inside of clip-on bracket 102. FIG. 3 also shows how return spring 132 is held inside of assembly 100 and how mechanical loading is provided to actuator 134. Retention spring 132 is designed having a length where it loads actuator 134 away from back wall 172. The back wall of clip-on bracket 102 includes a spring retention section 304 which helps maintain return spring 132 in its appropriate location. Bent finger 302 which is part of bracket 102 allows for added support to the assembly 100 by preferably being soldered to the surface of PCB 202. Finger 302 also provides a means of receiving ground potential from PCB 202 in order to provide shielding to switch assembly 100. Adding additional support to the front portion of the switch assembly are bent fingers 106 and 108 (not shown) which are wrapped around the edge of PCB 202.

One of the conductive wipers 136 which is part of piston wiper member 134 is shown making contact with one of the metalized traces found on the top surface of PCB 202. Conductive wiper 136 and 138 make pressure contact to the traces (pads) on the top portion of PCB 202. In the preferred embodiment, wiper contact 136 makes continues contact with the first metalized trace 148. The second wiper contact 138 (not shown) changes from making contact with the second metalized trace 146 when member 134 is not pressed in (in the first switch position), to making contact with the third metalized trace 150 when piston wiper member 134 is pressed inward (in the second switch position). Alignment member 120 is shown pressed to side notch 160 on PCB 144.

Figure 4:
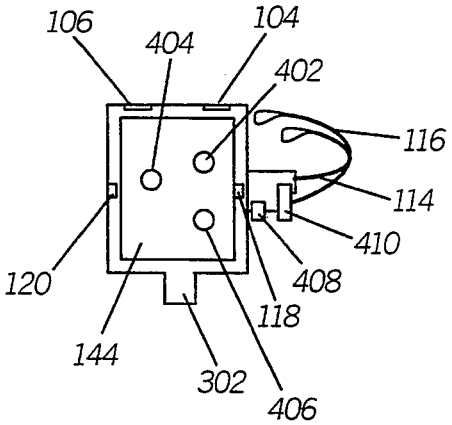
FIG. 4 is a bottom view of the switch assembly.

A bottom view of switch assembly 100 is shown in FIG. 4. The bottom surface 406 of PCB 144 includes three surface mount contacts 402, 404 and 406. Surface mount contact 402 is electrically connected to the second metalized trace 146 found on the top surface of PCB 144, surface mount contact 406 is electrically connected to the third metalized trace 150 and surface mount contact 404 is electrically connected to the first metalized trace 148.

Switch assembly 100 includes two more surface mountable contacts 408 and 410. Surface mount contact 408 is electrically connected to spring finger contact 114 and contact 410 which is electrically connected spring finger contact 116. Also shown in FIG. 4 are bendable fingers 104 and 106 and finger 302 which are part of clip-on bracket 102. Alignment members 118 and 120 helps to properly locate the switch assembly when it is ready to be mounted on to an external PCB (not shown).

Figure 5:
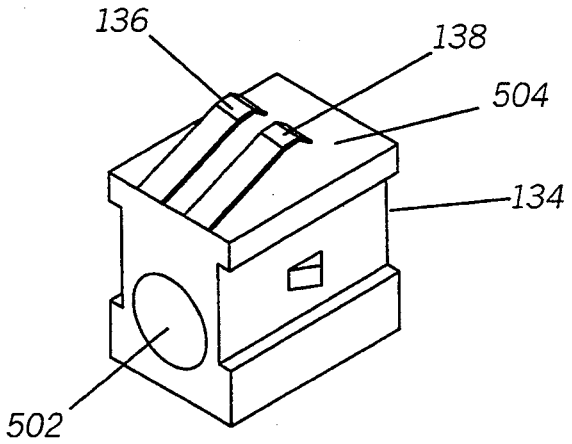
FIG. 5 is an isometric view of the switch actuator in accordance with the invention.

In FIG. 5, an isometric view of slideable actuator 134 is shown. The bottom surface 504 of wiper member 134 includes conductive wipers 136 and 138 which in the preferred embodiment are preferably insert molded to member 134. Preferably, a single metal piece of metal such as gold plated beryllium copper or nickel silver forms both conductive wipers. Conductive wipers 136 and 138 in the preferred embodiment are electrically interconnected to each other given that they are formed from a single piece of metal.

Figure 6:
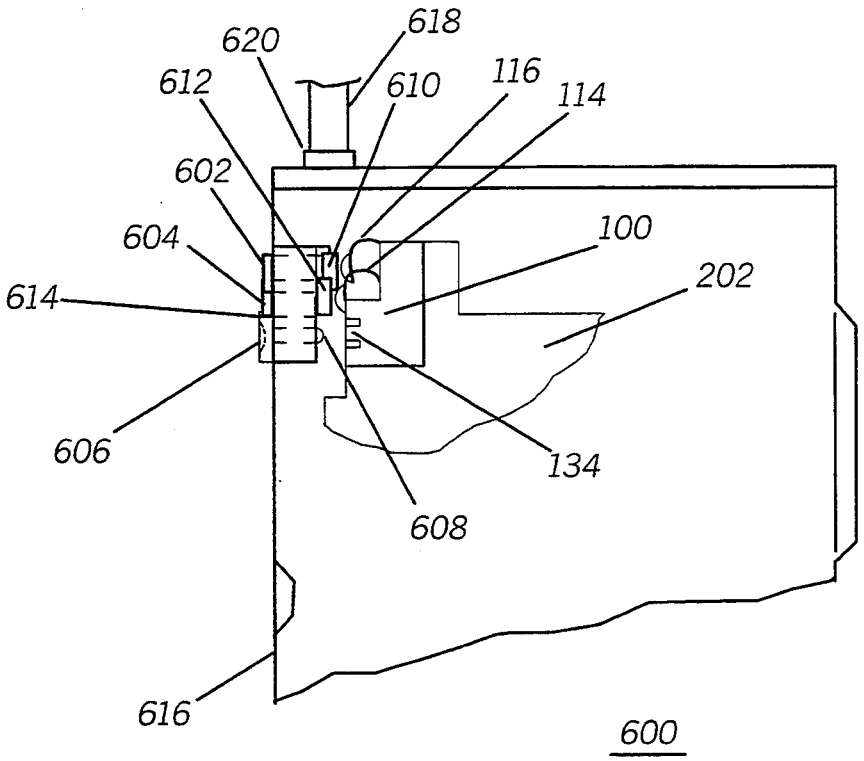
FIG. 6 is a partial cross-sectional view of a radio showing the switch assembly inside of the radio in accordance with the present invention.

Referring now to FIG. 6, a partial cross sectional view of a communication device such as a two way radio 600 is shown. Radio 600 includes a radio connector 614 which provides access to the internal circuitry of radio 600 to remote accessories and is also used for external programming of radio 600. Remote connector 614 includes first 602 and second 604 external contacts which are used to couple to the external accessory (e.g., public safety microphone, vehicular adapters, etc.). Some of the external accessories (i.e., those requiring the RF signal from radio 600) are designed such that the accessory connector which is coupled to radio connector 614 causes a plunger 606 to be pushed inward. This in turn causes movable actuator 134 of switch assembly 100 to be pressed inward by plunger end 608. The movement of actuator 134 causes wipers 136 and 138 to route the RF signals via spring finger contacts 114 and 116 to the external radio contacts 602 and 604.

Spring finger contacts 114 and 116 make pressure fit contact against corresponding conductive contacts 612 and 610 which are located on the inside wall of radio housing 616. Contact 610 is electrically connected to external contact 602, while contact 612 is electrically connected to external contact 604. Switch assembly 100 reroutes the RF signals which are normally sent from electronic circuitry (e.g., RF power amplifier) found on PCB 202 to antenna port 620/antenna 618 to radio connector 614 when an accessory that requires RF signals is attached to the connector. Accessories which require RF signals are designed to push in plunger 606 when attached to the connector, thereby causing switch 100 to reroute the RF signals.

Figure 7:
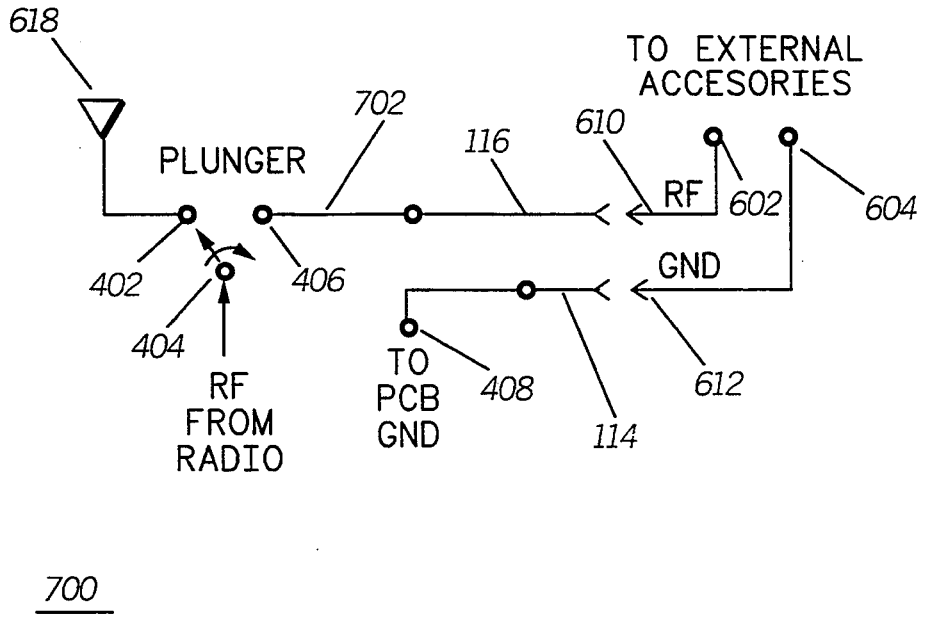
FIG. 7 is a schematic of the switch circuit in accordance with the present invention.

In FIG. 7, a schematic 700 showing how RF is switched using switch assembly 100 is shown. Radio antenna 618 is coupled to switch contact 402 and the RF from radio 600 is coupled to switch contact 404 thereby allowing RF to flow from radio 600 to antenna 618 when the switch is in the first position. When an external accessory is connected to external connector 614, the external radio accessory causes plunger 606 to be depressed into actuator 134 causing switch assembly 100 to switch to the second switch position. In the second position, actuator 134 causes contacts 404 and 406 to become electrically coupled. In the second position, RF from the radio is routed via spring finger 116 to the external connector contact 602. From contact 406 the RF signal travels through a small portion of runner 702 located on PCB 202 then to spring finger 116 which in turn is connected to internal contact 610.

Switch 100 provides electrical ground to the external accessory via spring finger 114 which is electrically connected to surface mount contact 408 and which is in turn coupled to ground potential on PCB 202. Spring finger contact 114 makes a pressure contact with inside contact 612 which in turn provides the ground to external contact 604. Likewise, spring finger contact 116 provides a pressure contact with internal contact 610 which is electrically connected to external contact 602.

The present invention provides the functions of a right angle board-to-board connector and a RF switch. In normal operation, when no RF accessory is attached to radio 600, RF power bypasses the connector and is sent to the radio's antenna 618. When an RF accessory, such as a public safety microphone or vehicular adapter is attached to radio 600, the external accessory causes a plunger 606 to push the slideable actuator 134 inward, causing the RF energy to exit the radio through the accessory connector directly to the external accessory bypassing radio antenna 618.

The present invention minimizes not only the size of the switch assembly, but also minimizes the number of movable parts in the switch 100. Switch assembly 100 includes five main parts, the switch circuit board 144, actuator 134, return spring 132, housing 112 including spring fingers 114 and 116, and clip-on bracket 102. The housing 112, PCB 144 and spring finger contacts 114 and 116 do not move relative to each other so each can be integrated through molding or other methods or can be separate pieces which can be assembled for operation.

The main moving component in switch assembly 100 is actuator 134 having wipers 136 and 138 which move relative to PCB 144 and causes the switching function to be performed. Actuator 134 in the preferred embodiment has wipers 136 and 138 which are insert molded into the actuator 134 to make a plastic piece that slides in-line along rails 126 and 130 found in housing 112. Wiper contacts 136 and 138 electrically connect to conductive pads (traces) located on switch PCB 144 in order to direct the RF signal in the proper direction (e.g., to the radio antenna or to the radio accessory connector 614). Actuator 134 is held in its normal first position through the force of return spring 132. When actuator 134 is depressed by plunger 606 to the actuators second switch position, the return spring continues to exert force on the actuator 134 until the plunger is no longer pushing into actuator 134 (radio accessory removed), whereby the return spring 132 pushes back actuator 134 to its first position.

Switch assembly 100 is attached to the radio PCB 202 through the surface mount soldering of pads 402, 404 and 406 located on switch PCB 144 and surface mount contacts 408 and 410. Spring finger contacts 114 and 116 originate at the radio PCB via contacts 408 and 410 and are formed to a right angle in order to make a pressure contact to the perpendicular surface of accessory connector 614.

What is claimed is:

1. A surface mountable switch assembly, comprising:

a switch housing having an outer wall and including a floor section having top and bottom surfaces, the bottom surface including first, second and third surface mountable contacts, the switch housing also having a cavity defined by inner walls;

a guide rail located on at least one of the inner walls of the cavity;

first and second spring finger contacts attached to the switch housing and extending out from the outer wall of the switch housing;

first, second and third traces located on the top surface of the floor section, the first trace electrically coupled to the first surface mountable contact, the second trace electrically coupled to the second surface mountable contact and the third trace electrically coupled to the third surface mountable contact; and a switch actuator having a pair of conductive wipers, the switch actuator located within the cavity and movable along the guide rail between a first position in which the first and second traces are electrically coupled to each other by the pair of conductive wipers, and a second position in which the first and third traces are electrically coupled to each other by the pair of conductive wipers.

2. A surface mountable switch assembly as defined in claim 1, further comprising:

a spring coupled to the switch actuator for mechanically loading the switch actuator.

3. A surface mountable switch assembly as defined in claim 2, further comprising:

a bracket which is attached to the switch housing, the bracket holding one end of the spring and the other end of the spring is held against the switch actuator.

4. A surface mountable switch assembly as defined in claim 1, wherein the floor section of the switch housing comprises:

a printed circuit board which is attached to the switch housing.

5. A surface mountable switch assembly as defined in claim 4, wherein the fourth and fifth surface mountable contacts are located on the switch housing and are formed from respective portions of the first and second spring finger contacts.

6. A surface mountable switch assembly as defined in claim 1, wherein the first and second spring finger contacts are molded to the switch housing and extend at a right angle out from the outer wall of the switch housing.

7. A surface mountable switch assembly as defined in claim 1, further comprising:

fourth and fifth surface mountable contacts, the fourth surface mountable contact electrically coupled to the first spring finger contact and the fifth surface mountable contact electrically coupled to the second spring finger contact.

* * * * *